United States Patent [19]

Leary et al.

[11] 4,419,980

[45] Dec. 13, 1983

[54] FLAMELESS HEAT GENERATOR

[76] Inventors: Charles L. Leary, 623 Andover St., Lawrence, Mass. 01843; Gerald C. Leary, 89 Page Rd., Bedford, Mass. 01730

[21] Appl. No.: 478,782

[22] Filed: Mar. 25, 1983

Related U.S. Application Data

[63] Continuation-in-part of Ser. No. 327,811, Dec. 7, 1981.

[51] Int. Cl.[3] ..... F24C 9/00

[52] U.S. Cl. ..... 126/247; 122/26; 366/328; 366/343; 366/307; 416/228

[58] Field of Search ..... 126/247; 122/26; 237/12.1; 165/86; 415/115, 217, 218; 416/231 A, 228 R; 366/147, 155, 307, 328, 341, 343

[56] References Cited

U.S. PATENT DOCUMENTS 1,718,175 6/1929 Nilson ..... 122/26

4,271,790 6/1981 Ahmed et al. ..... 122/26

4,365,614 12/1982 Grover ..... 126/247

*Primary Examiner*—Samuel Scott

*Assistant Examiner*—Randall L. Green

*Attorney, Agent, or Firm*—Lee A. Strimbeck

[57] ABSTRACT

A heating device generates heat by working a liquid in a closed container with a rotating stack of finely perforate square plates and recovering the heat from the thus heated liquid. In one embodiment a stack of a multiplicity of flat square plates radially offset one from another is rotated in an oil bath in a container under an inner perforate non-rotating cover over which is a similar non-rotating cover that is imperforate. The thermal energy developed through the mechanical working of the liquid is transferred to the main liquid bath and is then removed, as for example, by circulating air or a liquid around the outside of the container with the thus heated air or liquid being used to heat a house or the like.

6 Claims, 2 Drawing Figures

FLAMELESS HEAT GENERATOR

RELATED APPLICATION

Figure 1:
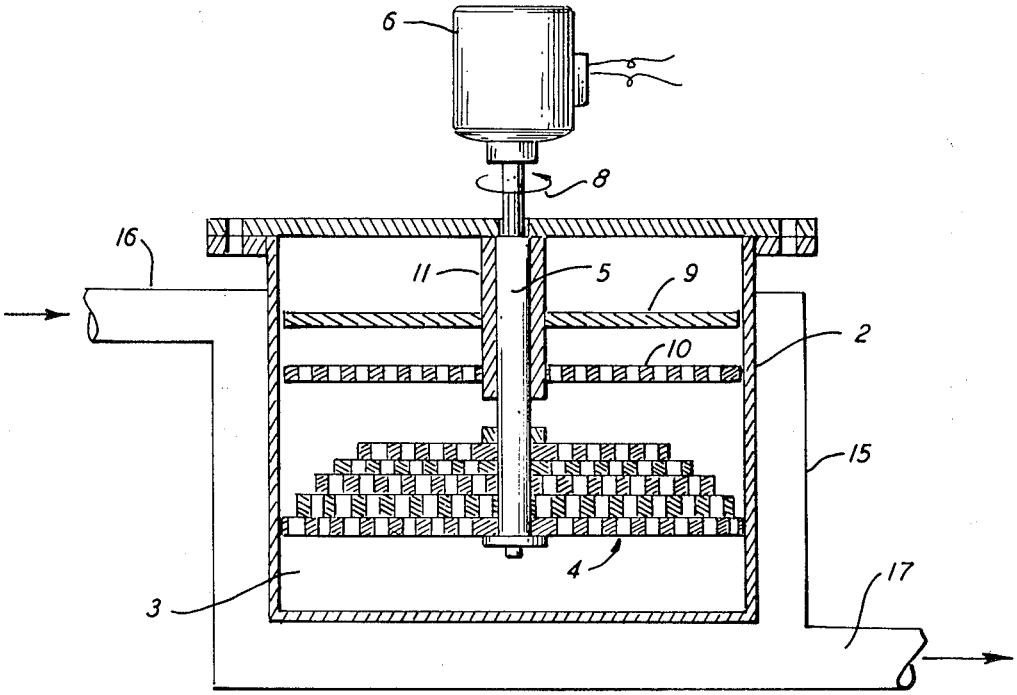

This application is a continuation-in-part of Ser. No. 327,811, filed Dec. 7, 1981, and having the same title and inventors.

| PRIOR ART | | |
|---|---|---|
| U.S. Pat. No. | Date | Name |
| 1,031,489 | July 2, 1912 | Thomson |
| 1,650,612 | Nov. 29, 1927 | Denniston |
| 1,682,102 | August 28, 1928 | Allen |
| 3,333,777 | August 1, 1967 | Graham |
| 4,143,639 | March 13, 1979 | Frenette |
| Foreign Pat. No. | Country | Name |
| 371,529 | West Germany | Olen |

THIS INVENTION

This invention is a flameless heat generator or space heating device that operates by mechanically working a heat transfer liquid with a rotating stack of closely spaced finely perforate square plates radially offset one from another, and recovering the heat from the heat transfer liquid. More particularly, this invention develops thermal energy by means of internal friction of the molecules in a hydrocarbon liquid by working the liquid with rapidly rotating closely spaced finely perforate square plates. Preferably the rotation of the plates is effected by means of an electric drive motor.

In brief compass, this invention is a flameless heating device comprising an enclosed container into which is journalled a drive shaft onto which is affixed a set of at least four stacked perforate square plates in face-to-face contact but offset one from another so that the corners are exposed. The container is supplied with a liquid, preferably a hydrocarbon oil, above the level of the plates. The set of plates is rotated rapidly by means of the drive shaft. The heat is removed from the main body of the liquid by any one of several means for use as desired. For example, the liquid can pass through a heat exchanger or air can be circulated around the container to be heated by the walls of the container in a heat exchange relationship with the liquid bath.

The plates are preferably square and have at least 1250 perforations per plate, preferably at least 50 per square inch. The drive shaft is usually perpendicular and the plates are mounted horizontally for rotation of the flat surface in a plane of rotation of the drive shaft.

In a preferred embodiment the enclosed container is cylindrical and the rotating diameter of the stacked plates is substantially less than the diameter of the container. A set of at least two flat stacked $\frac{3}{8}$" perforate stator bands are placed in the container about the rotating plates, with the perforations of the stator bands being slightly out of alignment to restrict the passageways between perforations.

Also, preferably, a sleeve about the drive shaft carries a non-rotating finely perforate inner cover just fitting within the cylindrical container, spaced above which is a like but imperforate non-rotating inner cover.

The perforate plates can be made of any suitable material such as a stamped $\frac{1}{8}$ inch steel plate. They can also be made of composite fiber/resin materials such as are used to make carbide grinding devices.

The working fluid is preferably a hydrocarbon that is normally liquid at 60° F. The hydrocarbon is preferably naphthenic and free of polymeric viscosity index improvers as such improvers tend to break down under continued use. The hydrocarbon liquid desirably does contain anti-oxidants and other additives that inhibit breakdown in use.

THE DRAWINGS

The two drawings attached hereto schematically illustrate one embodiment of this invention.

Figure 2:
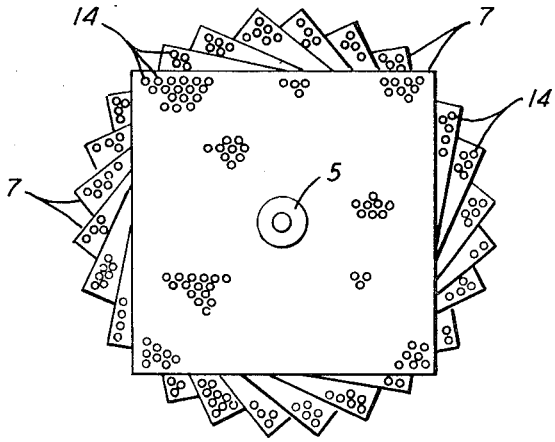

FIG. 1 shows in cross section a heating device having a single rotor with a stack of contiguous perforate offset square plates by which a hydrocarbon liquid is worked and heated, and FIG. 2 depicts a bottom view of the stack of perforate offset plates showing the manner of offset.

DESCRIPTION

Referring to FIG. 1, a container 2 is filled with a hydrocarbon liquid 3 surrounding a stack 4 of offset perforate square plates attached to and rotated by a shaft 5 driven by a motor 6. As shown in FIG. 2, the plates 7 are finely perforate with a multiplicity of holes 14. The plates are centrally disposed on the shaft 5 in a manner such as to be offset, as illustrated in FIG. 2. The plates are rapidly rotated as shown by direction arrow 8.

Shaft 5 carries two inner covers 9 and 10 held by a sleeve 11. The inner covers are mounted non-rotationally within container 2 with but slight clearance from the side walls. The inner cover 10 is slightly above the at rest level of the hydrocarbon liquid 3 and is finely perforate similar to plate 7, i.e. having at least 50 perforations per square inch. Upper inner cover 9 is imperforate and tends to confine the hydrocarbon liquid being worked to the underside thereof.

The working of the hydrocarbon fluid generates considerable heat. This heat is recovered in the embodiment shown by providing a plenum chamber 15 about the lower portion of container 2 into which is passed cool air by line 16 with warmed air being removed by line 17. Heat is transferred from the hydrocarbon liquid 3 through the walls of the container to the air circulating in plenum chamber 15. Alternatively, and not illustrated, the heated hydrocarbon oil 3 can be withdrawn, circulated through a heat exchanger and returned to the main oil bath. The heat exchanger could be used to heat water for household use.

EXAMPLE

With reference to the air heater shown in FIGS. 1 and 2, an experimental heating device uses a 0.625 inch thick stack of 8–6 inch square plates about 0.1 inches thick and offset as shown in FIG. 2. Each plate has about 81 holes per square inch. The rotating diameter of the plates is about 9 inches and the container 2 is slightly larger in diameter than this (10 inches). The drive shaft carrying the stack of plates also carries a perforated lower inner cover of 9 inch diameter having 4,241 perforations. Spaced slightly above the perforate cover, about an inch, is a solid metal cover of like diameter. The container 2 contains $2\frac{1}{4}$ quarts of 10–30W motor oil, to a depth of $2\frac{7}{8}$ inches. The plates are driven with a $\frac{3}{4}$ horsepower motor operating at 115 volts and 9.3 amps, i.e. producing 1070 kilowatts.

In another embodiment a container 9 inches in diameter was used to heat 2⅜ quarts of a 10—10W oil that passed continuously through an outlet at a side of the container, near the bottom, circulated through an attached copper coil immersed in a container of water and returned through an inlet at the floor of the container, heating the water in the process. In this embodiment 5 inch square plates were used, 8 in number, and each plate had 2,025 holes. The stack was about 0.625 inches thick. The circular covers were the same. In addition, stator bands consisting of 4 circular bands or straps ⅜" wide and stacked one on another were placed in the container about the rotating plates. Each band had approximately 490 ⅜" perforations and was slightly offset from its neighbors so that the perforations were out of alignment. These stator bands or plates improved the rate of heat buildup in the oil bath. The plates were driven with a ¾ horsepower motor operating at 115 volts and 7 amps, i.e. producing 805 kilowatts.

From a starting temperature of 60° F., the following temperature rises in the oil bath were recorded in the times noted:

| | |
|---|---|
| 50 Minutes-325° F. | (5.30° F. per minute) |
| 45 Minutes-315° F. | (5.66° F. per minute) |
| 50 Minutes-330° F. | (5.40° F. per minute)[1] |

[1]In this test a small amount of 10-30W oil was added to the 10—10W oil. Also, an 8½" circular steel plate, 1/32" thickness and finely perforated was placed on and slightly spaced from the container floor.

What is claimed is:

1. A heating device comprising, in combination:
a. an enclosed container;
b. a drive shaft journalled into said container;
c. a set of at least four stacked perforate square flat plates centrally mounted onto said drive shaft near its lower end but offset one from another to expose the corners thereof, the flat surfaces of each being in face-to-face contact and rotating in a horizontal plane in a plane of rotation of said drive shaft and having at least 50 perforations per square inch;
d. drive means for rapidly rotating said drive shaft;
e. a liquid within said container covering said plates and adapted to be heated by being worked by the rotation of said plates; and
f. heat exchange means for passing a heat transfer medium in indirect heat exchange with said liquid and recovering thermal energy therefrom.

2. The device of claim 1 wherein said container is cylindrical and said drive shaft extends downwardly along the axis of rotation thereof, and including a highly perforate fixed flat circular cover mating with said cylinder above the at rest level of said fluid, and a like but imperforate fixed cover spaced above said perforate cover.

3. The device of claim 1 wherein said heat transfer medium is air passed around the outside of said enclosed container.

4. The process of claim 1 wherein said heat transfer medium is water.

5. The device of claim 1 wherein there are at least eight of said stacked perforate plates with each plate having at least 1625 perforations per square plate.

6. The heating device of claim 2 wherein the rotating diameter of said stacked plates is substantially less than the diameter of said covers and wherein at least two fixed flat perforate bands are placed inside said container in the area of said stacked plates, said bands having perforate flat surfaces lying in a plane of rotation of said drive shaft with the perforations of each being out of alignment one from another.

* * * * *

UNITED STATES PATENT AND TRADEMARK OFFICE

CERTIFICATE OF CORRECTION

PATENT NO. : 4,419,980

DATED : December 13, 1983

INVENTOR(S) : Charles L. Carey et al.

It is certified that error appears in the above-identified patent and that said Letters Patent is hereby corrected as shown below:

On the title page, item /19/ "Leary et al." should read -- Carey et al. --.

Item /76/ "Charles L. Leary" should read -- Charles L. Carey --.

Signed and Sealed this

*Eighth* Day of *May 1984*

[SEAL]

*Attest:*

GERALD J. MOSSINGHOFF

*Attesting Officer*

*Commissioner of Patents and Trademarks*